US007533451B2

(12) United States Patent
Akashi et al.

(10) Patent No.: US 7,533,451 B2
(45) Date of Patent: May 19, 2009

(54) SLIDE FASTENER

(75) Inventors: Shunji Akashi, Runcorn (GB); Shigeyoshi Takasawa, Runcorn (GB); Morimasa Yoneoka, Prarolo (IT)

(73) Assignee: YKK Corporation, Tokyo (JP)

( * ) Notice: Subject to any disclaimer, the term of this patent is extended or adjusted under 35 U.S.C. 154(b) by 256 days.

(21) Appl. No.: 10/549,492

(22) PCT Filed: Mar. 15, 2004

(86) PCT No.: PCT/GB2004/001089

§ 371 (c)(1),
(2), (4) Date: Sep. 18, 2006

(87) PCT Pub. No.: WO2005/089583

PCT Pub. Date: Sep. 29, 2005

(65) Prior Publication Data

US 2007/0022579 A1 Feb. 1, 2007

(51) Int. Cl.
*A44B 19/26* (2006.01)

(52) U.S. Cl. ..... 24/386; 70/68

(58) Field of Classification Search ..... None
See application file for complete search history.

(56) References Cited

U.S. PATENT DOCUMENTS

| | | | | |
|---|---|---|---|---|
| 2,701,903 A | | 2/1955 | Williams | |
| 2,728,125 A | * | 12/1955 | Wild | 24/388 |
| 3,900,926 A | * | 8/1975 | Takahashi et al. | 24/386 |
| 4,047,264 A | * | 9/1977 | Takahashi et al. | 24/433 |
| 4,123,829 A | | 11/1978 | Takabatake | |
| 4,395,891 A | | 8/1983 | Remington | |

FOREIGN PATENT DOCUMENTS

| | | |
|---|---|---|
| EP | 0377798 A1 | 7/1990 |
| EP | 1300094 A1 | 4/2003 |

* cited by examiner

*Primary Examiner*—Jack W. Lavinder
(74) *Attorney, Agent, or Firm*—Alston & Bird LLP

(57) ABSTRACT

A slider (1) for a slide fastener comprises a slider body portion (7), a latchportion (3) and a crown portion (5). The crown portion (5) is disposed on the upper side (85) of the slider body portion (7) and the latch portion (3) is disposed on the underneath side (87) of the slider body portion (7). The latch portion (3) comprises a latching member (35) and a receiving portion (37) which engage with a receiving portion (37) and latching member (35) respectively on a second co-operating slider (2), to releasably latch the first (1) and second (2) sliders together.

7 Claims, 4 Drawing Sheets

SLIDE FASTENER

The present invention relates to slide fasteners or sliding clasp fasteners, in particular, but not limited to slide fasteners for bags and garments.

More particularly, the invention relates to slide fasteners having two moveable sliders such that the fastener may be opened at any point along its length.

Slide fasteners of the above type are well known in general. However, there is a tendency for the sliders to separate accidentally, so opening the fastener. In order to overcome this problem, different lockable fasteners have been suggested. However, these must have mechanisms which allow the locking to take place, and these mechanisms are often very complicated, requiring many parts in each slider.

In our application published as EP-A-1 300 094 we disclosed a slide fastener with a latching portion on one slider and a receiving portion on the other slider engageable with the latching portion. The latching portion and receiving portion are manually released to separate the sliders. The latching portion and the receiving portion are either formed integrally at the top of the slider body portion of the slider or are fixed on top of the slider body portion of the slider. In both of these arrangements the height of the slider is greater than the height of a typical slider. This increased height can cause the Slider to protrude from an article to which it is attached which makes the slider prone to collision with another object which may lead to wear and tear and ultimately breakage of the latching device and/or slider. Furthermore, the elevated position of the crown to which the puller is attached can cause the crown to break when the puller is pulled due to the increased leverage which can be exerted.

Therefore, a need for a low profile slider which hinders accidental separation of the sliders is seen.

According to a first aspect of the invention there is provided a slider for a slide fastener, the slider comprising a slider body portion which is slidable along a pair of interlocking stringers to engage and disengage the stringers, the slider body portion having an upper side for a puller or the like, for a user to slide the slider along the stringers and a latch portion on an underneath side of the slider body portion for engaging the slider with a co-operating slider. In use, the latch portion is on the inside of the item to which the slide fastener is attached, so that it is shielded from collision with another object.

Preferably the latch portion comprises a snap fit latching member for engaging and disengaging the co-operating slider.

Preferably the latch portion comprises a receiving member for receiving a latching member of the co-operating slider.

Preferably one or both of the latching member or the receiving member are resiliently deformed on engagement and disengagement with the co-operating slider.

Preferably the slider and co-operating slider are identical, thereby minimising the number of parts required.

Preferably the latch portion is attachable to the slider body portion by a form locking connection.

Preferably the form locking connection is comprised of one or more notches on the slider body portion which are slidably insertable into a corresponding number of recesses in the latch portion.

Preferably the notch is a ramp having a sloped face and an erect face, the erect face abutting a side of the recess to prevent retraction of the slider body portion from the latch portion.

According to a second aspect of the present invention there is provided a slide fastener comprising a first slider and a second slider arranged to be slidable on a pair of interlocking stringers so as to open the slide fastener when separated and close the slide fastener when brought together, each slider having a slider body portion, the slider body portion having an upper side for a puller or the like, for a user to slide each slider along the stringers, a receiving portion disposed on the underneath side of the first slider body portion and a latching member disposed on the underneath side of the second slider body portion and engageable with the receiving portion, wherein the receiving portion is arranged to engage with the latching member, to releasably latch the first and second sliders together.

According to a third aspect of the invention there is provided a slide fastener comprising a first slider and a second slider arranged to be slidable on a pair of interlocking stringers so as to open the slide fastener when separated and close the slide fastener when brought together, each slider having a slider body portion, the slider body portion having an upper side for a puller or the like, for a user to slide each slider along the stringers, a first receiving portion disposed on the underneath side of the first slider body portion, a first latching member disposed on the underneath side of the second slider body portion and engageable with the first receiving portion, a second receiving portion disposed on the underneath side of the first slider body portion, a second latching member disposed on the underneath side of the second slider body portion and engageable with the second receiving portion, wherein the first and second receiving portions are arranged to engage with the first and second latching members respectively, to releasably latch the first and second sliders together.

Preferably the first slider and second slider are identical, thereby minimising the number of parts required.

Preferably the latching member and receiving portion releasably latch as a snap fit connection.

Preferably one or both of the latching member or the receiving portion are resiliently deformed on engagement and disengagement with the other slider.

Preferably the latch member is attachable to the slider body portion by a form locking connection.

Preferably the form locking connection is comprised of one or more notches on the slider body portion which are slidably insertable into a corresponding number of recesses in the latch member.

Preferably the notch is a ramp having a sloped face and an erect face, the erect face abutting a side of the recess to prevent retraction of the slider body portion from the latch member.

According to a further aspect of the invention there is provided a slide fastener comprising a first slider and a second slider arranged to be slidable on a pair of interlocking stringers so as to open the slide fastener when separated and close the slide fastener when brought together, each slider having a slider body portion having upper and lower wings which sandwich slider elements between them, a puller or the like mounted on the upper wing, for a user to slide the slider along the stringers, a receiving portion disposed on the lower wing of the first slider body portion and a latching member disposed on the lower wing of the second slider body portion and engageable with the receiving portion, wherein the receiving portion is arranged to engage with the latching member, to releasably latch the first and second sliders together.

According to a further aspect of the invention there is provided a slide fastener comprising a first slider and a second slider arranged to be slidable on a pair of interlocking stringers so as to open the slide fastener when separated and close the slide fastener when brought together, each slider having a slider body portion, the slider body portion having upper and lower wings which sandwich slider elements between them, a puller or the like mounted on the upper wing, for a user to slide the slider along the stringers, a first receiving portion disposed on the lower wing of the first slider body portion, a first latching member disposed on the lower wing of the second slider body portion and engageable with the first receiving portion, a second receiving portion disposed on the lower wing of the first slider body portion, a second latching member disposed on the lower wing of the second slider body portion and engageable with the second receiving portion, wherein the first and second receiving portions are arranged to engage with the first and second latching members respectively, to releasably latch the first and second sliders together.

Preferably a force of between 15 and 25N is applied to release the first and second sliders. Preferably a force of between 18 and 22N is applied to release the first and second sliders. Preferably a force of 20N is applied to release the first and second sliders.

According to a further aspect of the invention there is provided a bag comprising a slide fastener having a pair of interlocking stringers on the edge of an opening in an outer wall of the bag, a first slider and a second slider arranged to be slidable on the stringers so as to open the slide fastener when separated and close the slide fastener when brought together, a receiving portion disposed on the first slider and a latching member disposed on the second slider and engageable with the receiving portion, wherein the receiving portion is arranged to engage with the latching member, to releasably latch the first and second sliders together and wherein the receiving portion and latching member are disposed on the inside of the bag.

According to a further aspect of the invention there is provided a bag comprising a slide fastener having a pair of interlocking stringers on the edge of an opening in an outer wall of the bag, a first slider and a second slider arranged to be slidable on the stringers so as to open the slide fastener when separated and close the slide fastener when brought together, a first receiving portion disposed on the first slider, a first latching member disposed on the second slider and engageable with the second receiving portion, a second receiving portion disposed on the second slider and a second latching member disposed on the second slider and engageable with the second receiving portion, wherein the first and second receiving portions are arranged to engage with the first and second latching members respectively, to releasably latch the first and second sliders together and wherein the receiving portion and latching member are disposed on the inside of the bag.

Preferably the first slider and second slider are identical, thereby minimising the number of parts required.

Preferably the latching member and receiving portion releasably latch as a snap fit connection.

Preferably one or both of the latching member or the receiving portion are resiliently deformed on engagement and disengagement with the other slider.

Preferably the latch member is attachable to the slider body portion by a form locking connection.

Preferably the form locking connection is comprised of one or more notches on the slider body portion which are slidably insertable into a corresponding number of recesses in the latch member.

Preferably the notch is a ramp having a sloped face and an erect face, the erect face abutting a side of the recess to prevent retraction of the slider body portion from the latch member.

Embodiments of the invention will now be described, by way of example, with reference to the accompanying drawings in which.

Figure 1:
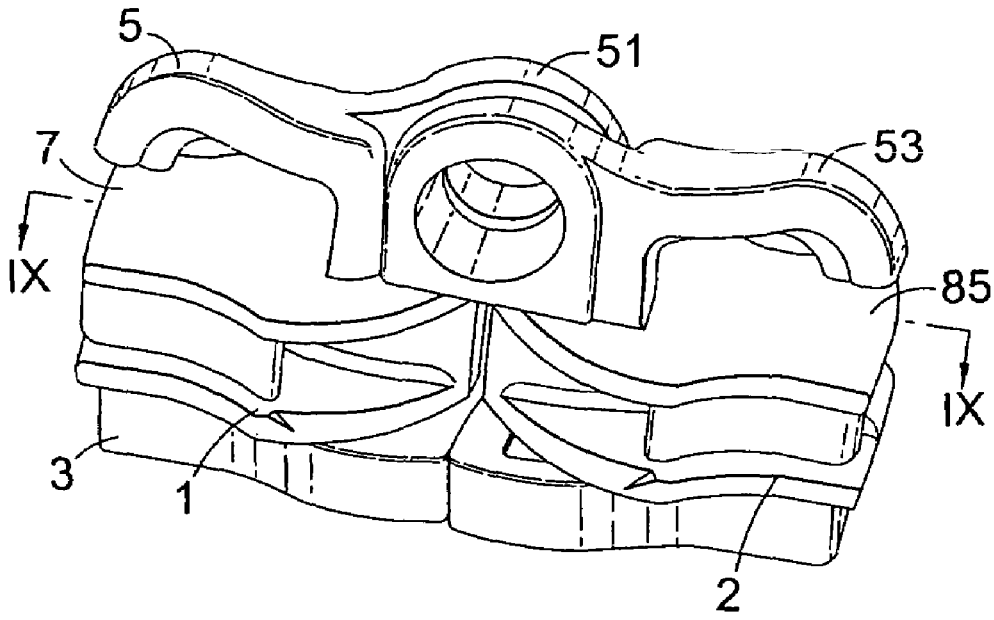
FIG. 1 is a perspective view of a first slider engaged with an identical second slider according to the present invention.
Figure 2:
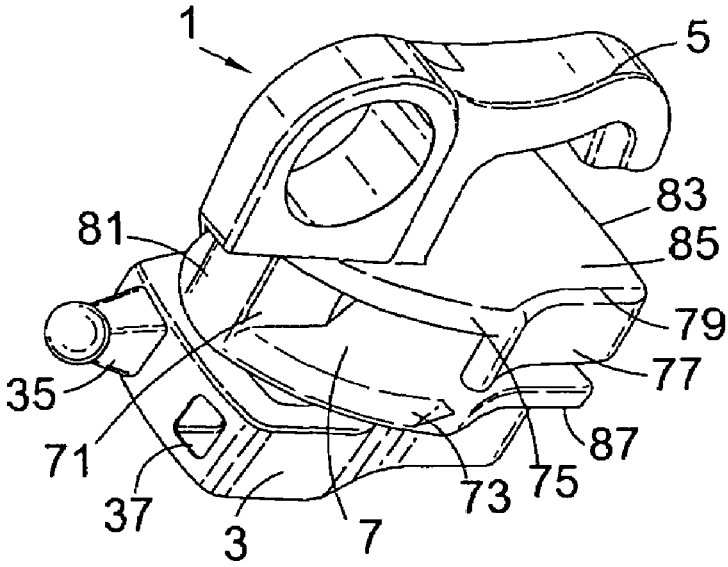
FIG. 2 is a perspective view of a slider of FIG. 1.

FIG. 1 is a perspective view of a first slider 1 engaged with an identical second slider 2. Each slider 1, 2 is comprised of a latch portion 3, a crown portion 5 and a slider body portion 7 located therebetween. The slider body portion 7 has a standard arrangement for separating and joining the engaging elements of the slide fastener stringers, as can been from FIG. 2 which is a perspective view of one slider 1 of FIG. 1. A neck 71 connects a lower wing 73 to an upper wing 75 which is parallel to the lower wing 73. The upper wing 75 has retaining flanges 77 on its the lateral edges 79, the flanges 77 extending in the direction of the lower wing 73. In another embodiment, there are retaining flanges 77 on both the lower wing 73 and the upper wing 75.

The lower wing 73 and upper wing 75 widen laterally from the front end 81 of the slider body portion 7 to the back end 83. The neck 71 is located at the front end 81 of the slider body portion 7 but does not run the full length of the slider body portion 7. In operation, the elements of a slide fastener (not shown) are located between the lower wing 73 and the upper wing 75, and the tape of the fastener stringers passes between the retaining flange 77 and the lower wing 73. As the slider 1 is moved forward, the retaining flanges 77 urge the teeth of the slide fastener together. As the slider 1 is moved backwards the neck 71 separates the teeth. According to the arrangement of FIG. 1 where the front ends of the two sliders 1, 2 face each other, as the sliders 1, 2 are moved away from each other the teeth of the slide fastener are urged apart and as the sliders 1, 2 are moved towards each other the teeth of the slide fastener are urged together, as is known in the art.

Referring to FIG. 1, the crown portion 5 is comprised of a loop 51 and a hook 53 which are integral with the outer surface 85 of the upper wing 75. A puller (not shown) can be attached to the hook 53 to facilitate movement of the slider 1 along a slide fastener. To provide access to the puller, the slider 1, 2 is arranged on the item to which it is attached such that the hook 53 is on the outer side. The loop 51 of one slider 1 aligns with the loop 51 of the second slider 2 so that a securing device, such as a padlock, may be passed through the loops 51 to secure the sliders 1, 2 together. In an alternative embodiment, there is no loop 51 on the crown portion 5 to provide securing of two sliders to each other. In an alternative embodiment, the hook 53 of the crown 5 is replaced by a loop, which receives the puller, as is known in the art.

The latch portion 3, which is described in more detail below, is attached to the outer surface 87 of the lower wing 73, which in is located on the underside of the slider, i.e. inside the article to which the slider 1 is attached. By not attaching the latch portion 3 to same side of the slider body portion 7 as the crown portion 5, the slider has the same external low profile as a standard slider and the parts of the slider 1, 2 are less prone to damage by collision with another object.

The slider 1, 2 may be produced as an integral unit, moulded or cast from metal or plastic. Alternatively, one or more of the latch portion 3, crown portion 5 or slider body portion 7 may be produced separately from metal or plastic and joined together by gluing or another method. In this embodiment the slider body portion 7 and crown portion 5 are formed integrally and the latch portion 3 is formed separately and attached to the lower wing 73 of the slider body portion 7 by a form locking connection, as described below.

Figure 4:
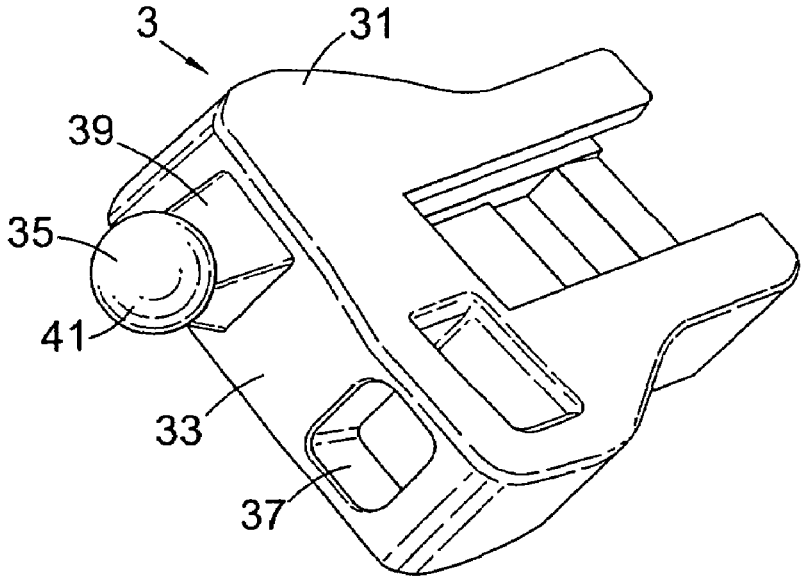
FIG. 4 is a perspective view of the latch portion of a slider of FIG. 1.
Figure 5:
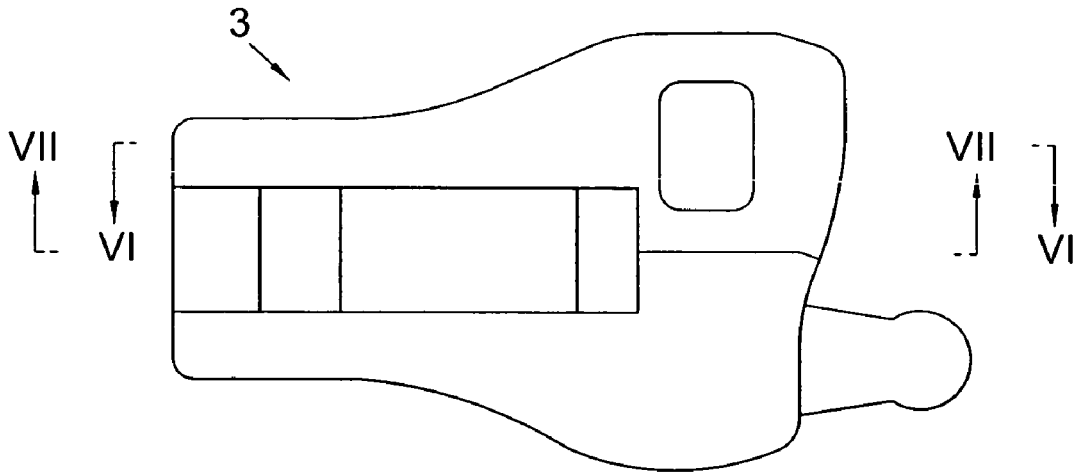
FIG. 5 is a top view of the latch portion of FIG. 4.

FIGS. 4-8 show various views of the latch portion 3 of FIG. 1. The latch portion 3 is comprised of a latching member and a receiving portion. Referring to FIG. 4, the latch portion 3 has a first surface 31 which abuts the lower wing 73 of the slider body portion 7 and a front abutting surface 33 which in use abuts the latch portion 3 of a corresponding slider. The abutting surface 33 of the latch portion 3 is laterally divided into a portion bearing a protrusion 35 and a portion bearing a tapered mouth 37. The protrusion 35 has a mushroom shaped cross section, comprised of a neck portion 39 adjacent to the abutting surface 33 and a rounded head portion 41 distal to the abutting surface 33. The protrusion 35 constitutes the latching member.

Figure 6:
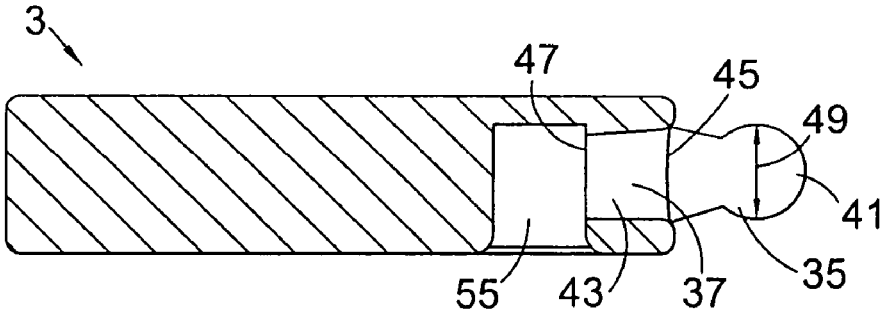
FIG. 6 is a section through plane VI-VI of FIG. 5.

Referring to FIG. 6, the tapered mouth 37 has a mushroom shaped cross section which can accommodate the protrusion 35. It is comprised of a neck portion 43 which narrows from its opening 45 to form a ridge 47 with a cross section smaller than the cross section of the widest point 49 of the head 41 of the protrusion 35. Beyond the ridge 47, the tapered mouth 37 widens to form a head 55. The tapered mouth 37 constitutes a receiving portion for receiving a latching member. The latching member and the receiving portion are integrally molded to form the latch portion 3. In the latch portion 3, the latching member is disposed beside the receiving portion for receiving the latching member of a mating latch portion.

Figure 3:
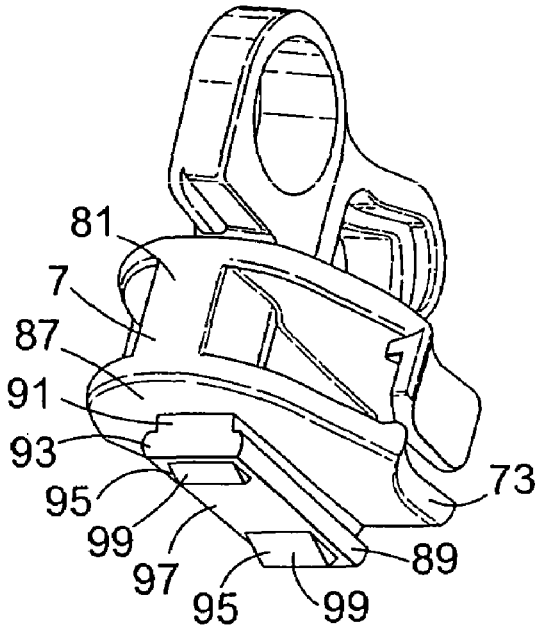
FIG. 3 is a perspective view of a slider of FIG. 1 with the latch portion removed.
Figure 8:
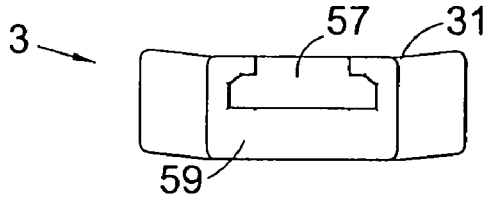
FIG. 8 is an end view of the latch portion of FIG. 4.

FIG. 3 is a perspective view of the slider 1, 2 of FIG. 1 with the latch portion 3 removed. The latch portion 3 is attached to the slider body portion 7 by means of a protrusion 89 on the outer surface 87 of the lower wing 73 of the slider body portion 7 which is inserted into a cavity 57 in the first surface 31 of the latch portion 3, as shown in FIG. 8.

The protrusion 89 on the outer surface 87 of the lower wing 73 of the slider body portion 7 has a T-shaped cross section, having a neck 91 adjacent to the outer surface 87 of the lower wing 73 and a head 93 distal to the outer surface 87. The cavity 57 in the first surface 31 of the latch portion 3 runs from the rear face 59 of the latch portion 3 and also has a T-shaped cross section, to allow the protrusion 89 of the slider body portion 7 to be inserted longitudinally into the cavity 57, to attach the slider body portion 7 to the latch portion 3.

Figure 7:
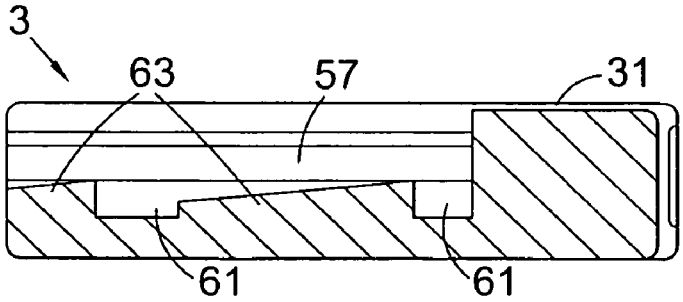
FIG. 7 is a section through plane VII-VII of FIG. 5.
Figure 9:
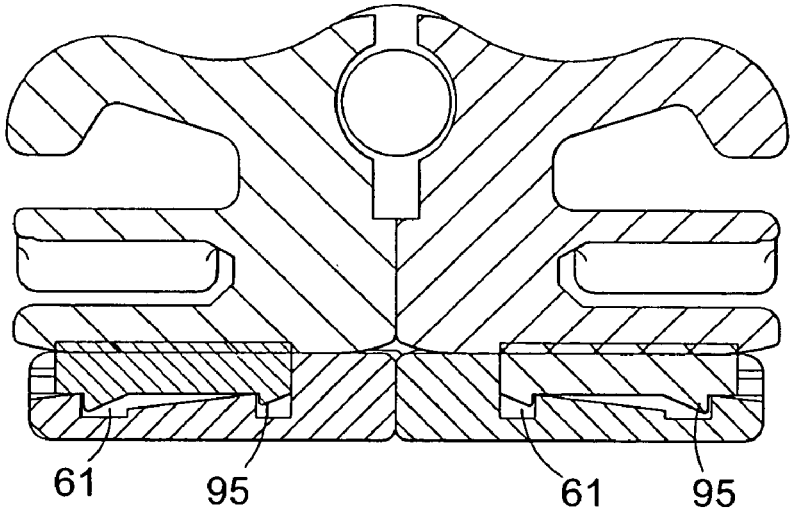
FIG. 9 is a section through plane IX-IX of FIG. 1.

Referring to FIG. 3, there are two saw-tooth shaped notches 95 located along the outside 97 of the head 93 of the protrusion 89. Each notch 95 has a sloped surface 99 and an upright surface. The sloped surface 99 of the notches faces towards the front 81 of the slider body portion 7. The upright surface of the notches 95 faces toward the rear of the slider body portion 7. Referring to FIG. 7, there are two corresponding recesses 61 in the cavity 57 in the first surface 31 of the latching portion 3. Leading up to each of these recesses 61 are ramps 63 along which the sloped surface 99 of the notches 95 slide when the slider body portion 7 is inserted into the cavity 57 in the first surface 31 of the latching portion 3. FIG. 9 is a section through plane IX-IX of FIG. 1, which shows that the notches 95 have been inserted into the recesses 61 until the upright surfaces of the notches 95 are brought into abutting engagement with the relevant sides of the recesses 61, so that the notches 95 are engaged with the recesses 61.

Alternatively, the latch portion 3 may be glued to the slider body portion 7, or another suitable attaching means may be used.

Referring to FIG. 1, it can be seen that two identical first and second sliders 1, 2 can be latched together. The latch portion 3 of each slider 1, 2 includes the latching member and the receiving portion. The first slider 1 has a first receiving portion disposed on its latch portion 3. The second slider 2 has a first latching member disposed on its latch portion 3 and adapted for engagement with the first receiving portion of the first slider 1. Furthermore, the second slider 2 has a second receiving portion disposed on its latch portion 3. The first slider 1 has a second latching member disposed on its latch portion 3 and adapted for engagement with the second receiving portion of the second slider 2. This means that each slider 1, 2 has a latch portion 3 of the same construction disposed on the underneath side of its slider body portion. This has the advantage that a small number of parts is required to make up a pair of mating sliders 1, 2.

A force must be applied to engage two sliders 1, 2 in order to push the head 41 of the protrusion 35 of each latch portion 3 beyond the ridge 47 of the corresponding tapered mouth 37 in the abutting surface 33 of the other latch body portion 3. The force required depends on the geometry of the protrusion 35 and the tapered mouth 37 and the material from which they are made. The arrangement provides a snap fit connection between the latch portions 3. Preferably a force of between 15 and 25N is required to pull the latch portions apart. Further preferably a force of between 18N and 22N is required to pull the latch portions apart. Further preferably a force of 20N is required to pull the latch portions apart. Either or both of the ridge 47 and the head 41 are subjected to elastic deformation. With elastic deformation, the head 41 comes into engagement with the ridge 47, to thus provide a snap fit connection between the latch portions 3; and the head 41 comes out of engagement with the ridge 47, so that the latch portions 3 are separated.

Figure 10:
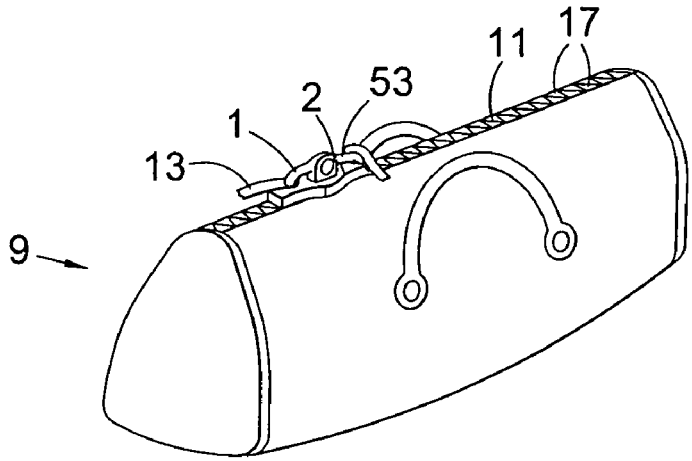
FIG. 10 is a perspective view of a bag with a zip fastener and two sliders of FIG. 1.

FIG. 10 is a perspective view of a bag 9 with a zip fastener 11 and two sliders 1, 2 of FIG. 1. A puller 13 is attached to the crown 53 of each the sliders 1, 2 to move the slider 1, 2 along the zip fastener 11 to engage or disengage the elements 17 of the zip fastener 11. The latch portion 3 is located inside the bag 9.

Although the above embodiments of the slider relate to a zip fastener embodiment, it will apply equally to any other type of slider and it should be appreciated that further modifications and variations will suggest themselves to those versed in the art upon making reference to the foregoing description, which is given by way of example only and which is not intended to limit the scope of the invention.

The present invention has been described above purely by way of example, and modifications can be made within the spirit of the invention.

The invention claimed is:

1. A slide fastener comprising:

a first slider and a second slider arranged to be slidable on a pair of interlocking stringers so as to open the slide fastener when separated and close the slide fastener when brought together, each slider having a slider body portion, the slider body portion having an upper side for a puller, for a user to slide the slider along the stringers;

a first receiving portion disposed on the underneath side of the first slider body portion;

a first latching member disposed on the underneath side of the second slider body portion and engageable with the first receiving portion;

a second receiving portion disposed on the underneath side of the second slider body portion; and a second latching member disposed on the underneath side of the first slider body portion and engageable with the second receiving portion;

wherein the first and second receiving portions are arranged to engage with the first and second latching members, respectively, to releasably latch the first and second sliders together.

2. The slide fastener of claim 1, wherein the first slider and the second slider are identical.

3. The slide fastener of claim 2, wherein the first latching member and the first receiving portion releasably latch as a snap fit connection and the second latching member and the second receiving portion releasably latch as a snap fit connection.

4. The slide fastener of claim 3, wherein one or more of the latching members or the receiving portions are resiliently deformed on engagement and disengagement with the other slider.

5. The slide fastener of claim 4, wherein a first latch member is attachable to the first slider body portion and a second latch member is attachable to the second slider body portion by a form locking connection, the first latch member comprising the first latching member and the second receiving portion, and the second latch member comprising the second latching member and the first receiving portion.

6. The slide fastener of claim 5, wherein each form locking connection is comprised of one or more notches on each slider body portion, the one or more notches being slidably insertable into a corresponding number of recesses in the respective latch member.

7. The slide fastener of claim 6, wherein each of the one or more notches comprises a ramp having a sloped face and an erect face, the erect face abutting a side of the corresponding recess in the respective latch member to prevent retraction of each slider body portion from the respective latch member.

* * * * *